United States Patent [19]

Bizic et al.

[11] Patent Number: 4,974,825

[45] Date of Patent: Dec. 4, 1990

[54] ENVELOPE FEEDER WITH SEPARATOR SHUTTLE ASSEMBLY

[75] Inventors: Milan Bizic, Danikon, Switzerland; David L. Davis, Indianola; Charles T. Higgins, Kirkland, both of Wash.

[73] Assignee: Ciba-Geigy Corporation, Ardsley, N.Y.

[21] Appl. No.: 242,401

[22] Filed: Sep. 9, 1988

[51] Int. Cl.[5] ..... B65H 5/00

[52] U.S. Cl. ..... 271/2; 271/14; 271/30.1; 271/103; 271/104; 271/106; 271/128; 271/269

[58] Field of Search ..... 271/2, 5, 11, 14, 20, 271/42, 90, 104, 105, 106, 107, 108, 30.1, 121, 137, 128, 267, 269, 271, 167, 168, 169, 171, 103

[56] References Cited

U.S. PATENT DOCUMENTS

| | | | |
|---|---|---|---|
| 937,807 | 10/1909 | Hodge | 271/14 |
| 1,068,891 | 7/1913 | Green . | |
| 2,336,499 | 12/1943 | Murch et al. | 271/14 |
| 2,850,279 | 9/1958 | Stoothoff et al. | 271/103 |
| 3,067,885 | 12/1962 | Kohler . | |
| 3,100,110 | 8/1963 | Winkler et al. | 271/104 |
| 3,172,655 | 3/1965 | Lenk | 271/2 |
| 3,281,142 | 10/1966 | Treff | 271/2 |
| 3,287,011 | 11/1966 | Currie . | |
| 3,394,930 | 7/1968 | Guggisberg | 271/11 |
| 4,013,283 | 3/1977 | Tress et al. | 271/14 |
| 4,359,216 | 11/1982 | Leonard . | |
| 4,381,168 | 4/1983 | Johnson et al. . | |
| 4,406,447 | 9/1983 | Fichte et al. . | |
| 4,480,826 | 11/1984 | Kaneko . | |

FOREIGN PATENT DOCUMENTS

| | | | |
|---|---|---|---|
| 0259261 | 3/1988 | European Pat. Off. | 271/2 |
| 295273 | 3/1954 | Switzerland | 271/14 |
| 616388 | 3/1980 | Switzerland . | |

*Primary Examiner*—H. Grant Skaggs
*Assistant Examiner*—Boris Milef
*Attorney, Agent, or Firm*—Christensen, O'Connor, Johnson & Kindness

[57] ABSTRACT

An envelope feeder (20) for use in a photographic order-finishing station, including a base (22) to which a retaining plate (28) is mounted. A stack-holding tray (30) is biased toward the retaining plate to compress a stack (18) of envelopes placed therebetween for feeding. Suction heads (50) move arcuately to contact and grip the outermost envelope (36) on the stack by application of a partial vacuum, and the move back to peel and lift a portion of that envelope from the stack. A shuttle assembly (52) with a plurality of narrow shuttle fingers (108) is included for insertion between the partially lifted outermost envelope (36) and the underlying envelope (68) to split any adhesions formed between them and separate the outermost envelope from the stack. After insertion of the shuttle assembly, the suction heads release the envelope and latching tabs (114) mounted on the shuttle assembly rotate to project outwardly toward the retaining plate, engaging the outermost envelope so that it is removed from the stack as the shuttle assembly is retracted. The removed envelope is fed into an envelope receptacle (48) as it is removed from the stack.

6 Claims, 4 Drawing Sheets

ENVELOPE FEEDER WITH SEPARATOR SHUTTLE ASSEMBLY

BACKGROUND OF THE INVENTION

The present invention relates to an apparatus for removing the outermost sheet of material from a stack of such sheets and, more particularly, relates to an apparatus in a photofinishing station for removing the outermost envelope from a stack of envelopes and presenting that envelope for subsequent handling.

The apparatus will be described in terms of an envelope feeder in a photofinishing station, for which the apparatus is particularly well suited, but it should be understood that the apparatus can also be used to feed other sheet materials in other environments.

In the photofinishing industry, a customer's film is delivered to a processing lab in an envelope bearing customer identification. The film is removed from the customer envelope for processing, and the customer envelope is retained. Typically, the developed film and prints made therefrom are funneled to an operator station for reinsertion into the used envelope for return to the customer. Since labs tend to process a large quantity of film, individual customer envelopes, film, and prints are maintained in corresponding sequential order for correct matching by the operator. To maximize efficiency, it is desired that corresponding envelopes, film, and prints be automatically presented one by one to the operator. Typically, customer envelopes are queued in a stack at the operator's station, and then separated and presented by a high-speed feeder.

Sheet feeders have been developed that grip the outermost sheet with a high-friction or suction gripper, and then slide that sheet off the stack of sheets. However, these feeders do not work well for feeding used customer photo envelopes, since the envelopes are wrinkled and tend to interfere with each other, making sliding separation difficult. In addition, some envelopes may contain adhesive, tape, or staples that tend to bind adjacent envelopes together, making sliding seperation even more difficult.

This difficulty has been partially overcome by sheet feeders that grip the outermost sheet and then peel that sheet from the stack. However, such feeders tend to fail to separate customer photo envelopes that are adhered together, and generally feed sheets at a rate that is too slow for the photofinishing industry.

SUMMARY OF THE INVENTION

The present invention presents an envelope feeder that removes the outermost envelope from a stack of envelopes and presents that envelope for subsequent handling.

The envelope feeder includes a base and a retaining plate secured perpendicularly to the base. A stack-holding tray is slidably secured perpendicularly to the base and is biased toward the retaining plate. A stack of envelopes can be inserted between, and are compressed by, the stack-holding tray and the retaining plate, with the outermost envelope facing the retaining plate.

A gripping-surface portion of the outermost envelope is exposed beyond the retaining plate. A plurality of suction heads are mounted on a gripper rod that is pivotally secured perpendicular to the base in proximity to the gripping-surface portion. Each suction head has a suction cup gripper mounted on one end, and is connected to a vacuum system. The gripper rod moves arcuately between a pickup position, in which the suction cups contact the gripping-surface portion of the outermost envelope, gripping that envelope when a partial vacuum is drawn; and a release position, in which the suction head is spaced away from the stack, peeling and lifting the gripping-surface portion of the outermost envelope away from the stack and holding it there until the partial vacuum is released.

The envelope feeder includes a shuttle assembly slidably mounted to the base, the shuttle assembly having a stand-off rod and a separator rod that are parallel to each other and perpendicular to the base. The shuttle assembly includes a plurality of parallel, elongated shuttle fingers, each having a narrow separating tip secured to and periodically spaced along the separator rod, projecting outwardly from the stack adjacent the gripping-surface portion of the outermost envelope and parallel to the retaining plate.

A plurality of latching tabs are rotatably secured to the separator rod above the separating tips, and are spring-biased to a removal position, in which they project toward the retaining plate. The latching tabs may be depressed to a separating position, in which they overlie and are parallel to the shuttle fingers.

The shuttle assembly is movable between a retracted position and an inserted position. In the retracted position, the stand-off rod is located between the retaining plate and the outermost envelope, creating a gap between the stack and the retaining plate, and the separator rod is located adjacent the stack of envelopes. After the gripping-surface portion of the outermost envelope has been lifted from the stack by the suction heads, the shuttle assembly is slid to its inserted position, with the separating tips of the shuttle fingers being inserted between the outermost envelope and the rest of the envelopes in the stack, and the latching tabs being depressed to their separating positions. The underlying envelopes in the stack are engaged by a spring holder to prevent their lifting and obstructing the path of the shuttle assembly. Rollers with low-friction roller surfaces are rotatably secured to the shuttle rod and the stand-off rod to aid insertion of the shuttle.

As the shuttle fingers are inserted further, the outermost envelope is split from the stack and pressed against the retainer plate. When the shuttle assembly has been fully slid to its inserted position, the stand-off rod and separating tips of the shuttle fingers have passed completely through the stack and project outwardly from the opposite side of the stack, allowing the latching tabs to rotate to their removal positions. With the shuttle assembly in this configuration, the outermost envelope is completely separated from the stack, and is located between the shuttle fingers and the retaining plate.

The partial vacuum drawn by the suction heads is then released to detach the gripping-surface portion of the outermost envelope in preparation for removal of that envelope from the stack. The shuttle assembly is moved back to its retracted position, with the latching tabs remaining in their removal position to engage the outermost envelope so that the outermost envelope travels with the shuttle. As the shuttle fingers retract from the stack, the outermost envelope is received in a receptacle for presentation to an operator.

Since the uppermost envelope is separated from the stack by insertion of the shuttle fingers, adhesions between the uppermost envelope and the next underlying envelope in the stack, resulting from wrinkles, adhesive, and staples, are readily split.

Controllers for the movement of the shuttle assembly rotation of the gripper rod, and operation of the vacuum system allow the envelope feeder to sequence rapidly through another envelope separation and removal cycle each time the previously presented envelope is removed from the receptacle by the operator.

BRIEF DESCRIPTION OF THE DRAWINGS

These and other advantages of the present invention will be readily understood by those of ordinary skill in the art, upon reading the following specification in conjunction with the appended drawings, in which.

DETAILED DESCRIPTION OF THE PREFERRED EMBODIMENT

Figure 1:
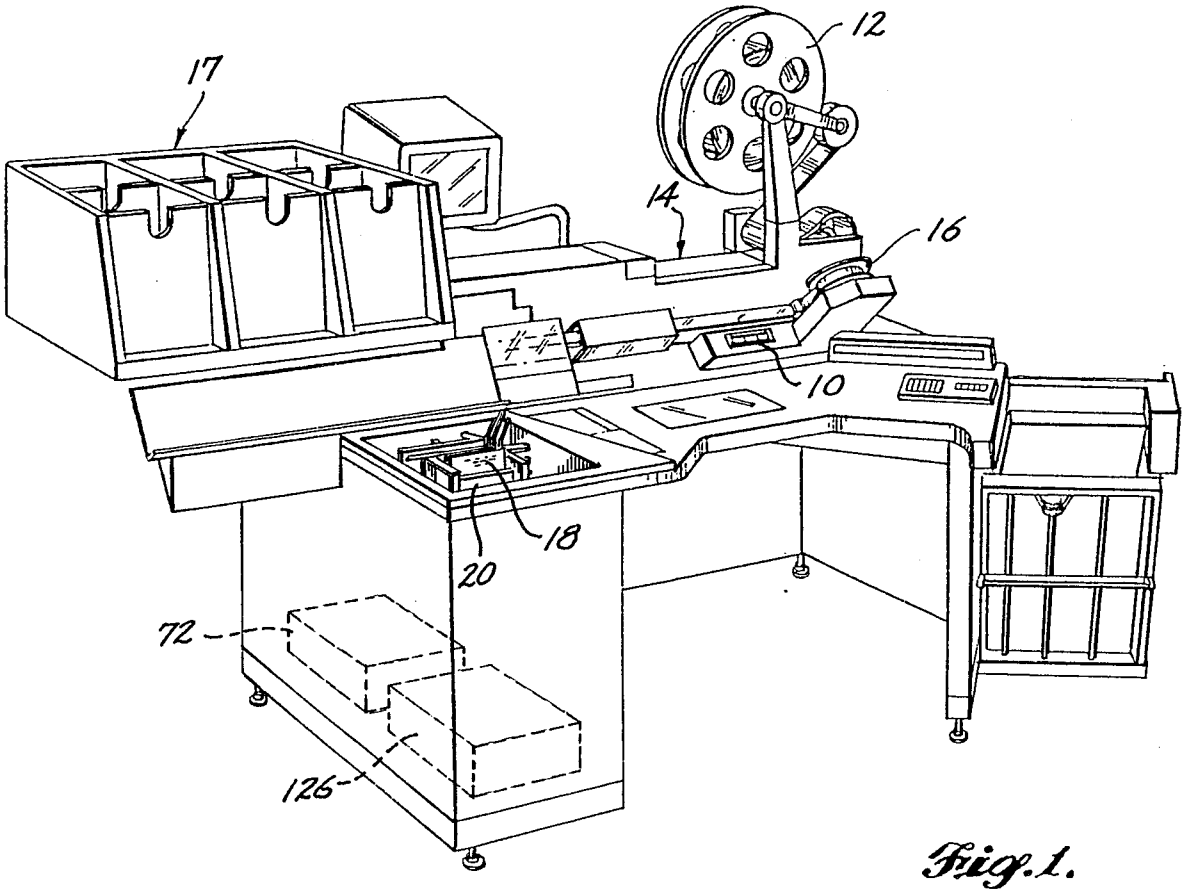
FIG. 1 shows the envelope feeder mounted within a photograph order-finishing station.

FIG. 1 shows the present invention mounted within a photographic order-finishing station 10 where developed film, prints made from the film, and original customer envelopes are funneled for combination and return to the customer. At the order-finishing station 10, a reel of prints 12 is mounted for delivery to a print cutter 14 that separates the prints into individual pictures. A roll 16 of developed film or negatives is also mounted on the order-finishing station 10 for concurrent separation into customer groupings to match the prints being cut by the print cutter 14. The corresponding prints and negatives are placed into wallets that are delivered from a wallet feeder 17 mounted on the order-finishing station 10.

Typically, the only information the processing lab has concerning the identity of the customer to whom the prints and film belong is written on the original customer envelope in which the film was delivered to the lab. To assure proper rematch at the order-finishing station 10, the film, prints, and envelopes are maintained in sequential order during processing. In addition, matching bar code labels are often placed on corresponding envelopes and film to assure proper matching in the event that the sequence is dirupted. A stack 18 of original customer envelopes is placed within an envelope feeder 20 mounted within the order-finishing station 10 to feed the envelopes one by one to the station operator for combination with the corresponding film and prints. Each time an envelope is removed from the envelope feeder 20 by the operator, an envelope separation and removal cycle is performed by the feeder to present another envelope to the operator.

Figure 4:
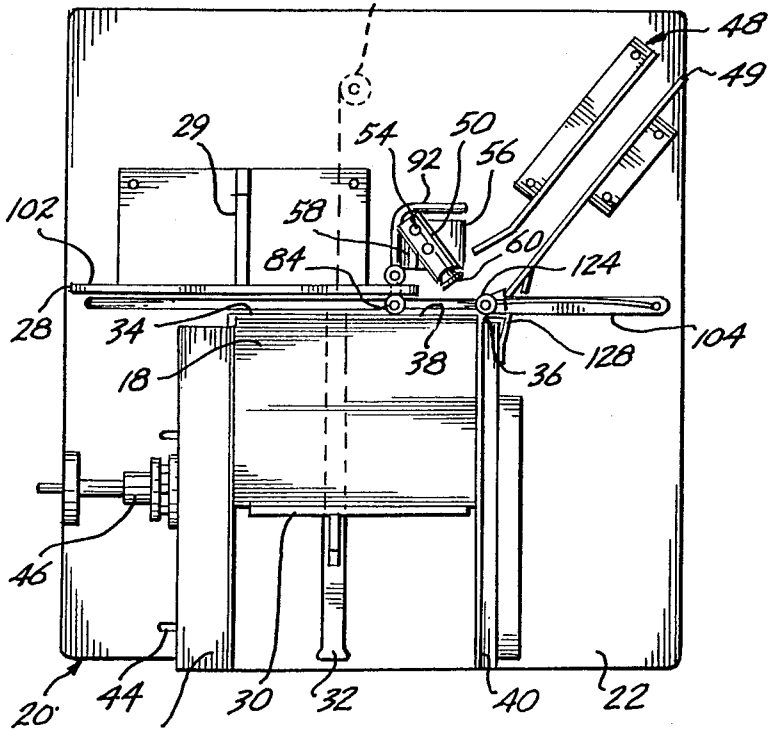

FIG. 4 shows a top view of the preferred embodiment of an envelope feeder 20, constructed in accordance with the present invention, at the start of an envelope separation and removal cycle. The preferred embodiment includes a base 22, with an upper surface 24 and a lower surface 26, mounted horizontally within the order-finishing station 10. The envelope feeder 20 could alternatively be disposed vertically or on a slant within the order-finishing station 10.

The envelope feeder 20 includes a rectangular retaining plate 28, affixed by a bracket 29 to the upper surface 24 of the base, projecting upwardly from, and perpendicularly to, the base 22. A stack-holding tray 30 is slidably secured within a tray slot 32 included in the base 22. The stack-holding tray 30 is parallel to and faces the retaining plate 28, sliding toward and away from retaining plate 28 within tray slot 32. A conventional spring motor 33, mounted to the lower surface 26 of the base 22 and to the stack-holding tray 30, advances the stackholding tray 30 toward the retaining plate 28.

The stack-holding tray 30 is drawn away from the retaining plate 28 to load the stack 18 of envelopes between the stack-holding tray 30 and the retaining plate 28, where the stack 18 is lightly compressed. The outer surface 34 of the outermost envelope 36 of the stack 18 faces the retaining plate 28, with a gripping-surface portion 38 of the outer surface 34 exposed beyond retaining plate 28.

Still referring to FIG. 4, it can be seen that the stack 18 is also confined by a first side plate 40 and a second side plate 42, with stack-holding tray 30 sliding between first and second side plates 40 and 42. The first side plate 40 is affixed perpendicularly to the base 22, and is perpendicular and spaced slightly away from the retaining plate 28 in proximity to the gripping-surface portion 38 of the outermost sheet 36. The second side plate 42 is slidably secured within two side plate slots 44 included in the base 22, is parallel to the first side plate 40, and is also spaced slightly away from the retaining plate 28. The position of the second side plate 42 is adjusted by an adjuster 46 to allow the envelope feeder 20 to accommodate varying widths of envelopes.

The envelope feeder 20 functions to remove the uppermost envelope 36 from the stack 18 and feed it into an envelope receptacle 48 affixed perpendicularly to the base 22. Envelope feeder 20 is formed by two parallel plates 49 that are spaced apart to receive envelopes therebetween, and is located radially adjacent the gripping-surface portion 38 of the outermost envelope 36.

Figure 2:
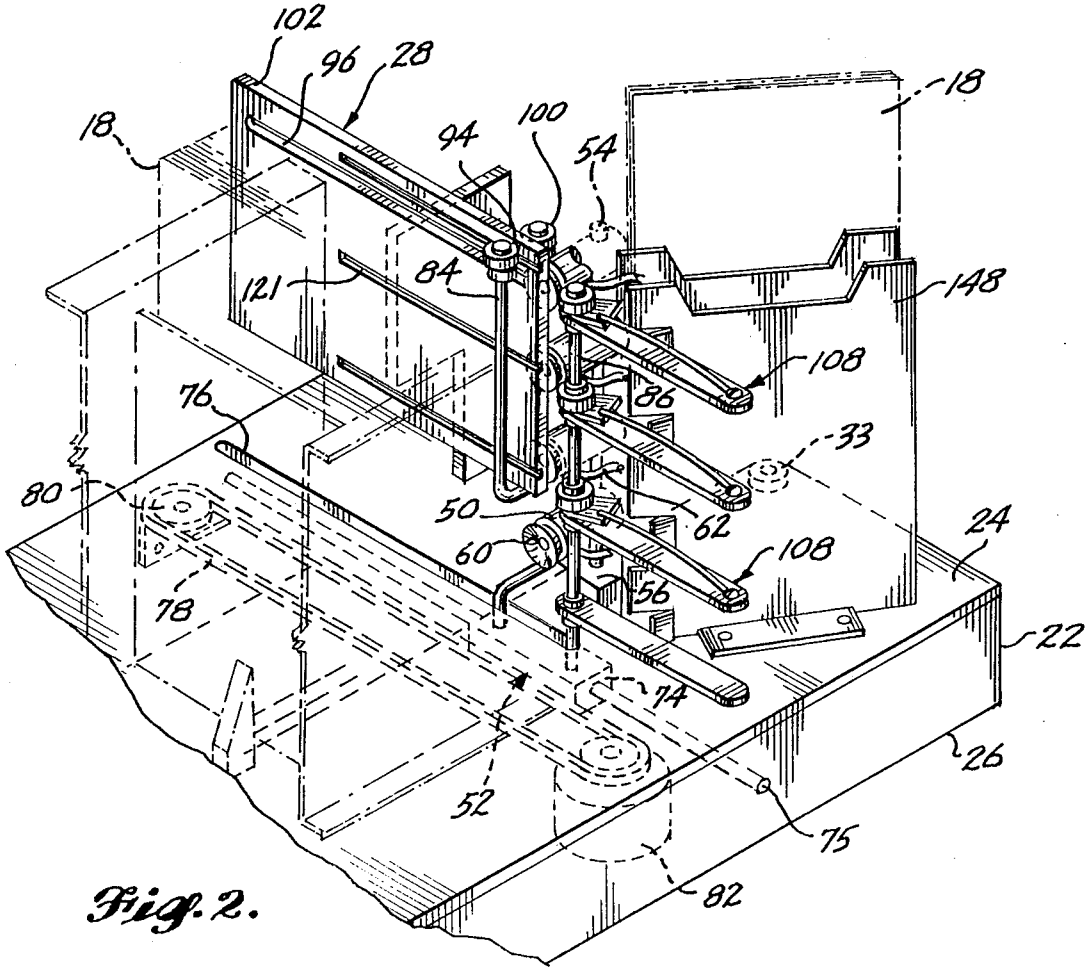
FIG. 2 is an isometric view of the envelope feeder prior to loading a stack of envelopes.

Removal of the outermost envelope 36 is accomplished by lifting and peeling the gripping-surface portion 38 with four cylindrical suction heads 50 and then separating and removing that envelope from the stack with a shuttle assembly 52. FIG. 2 illustrates the suction heads 50 and the shuttle assembly 52 in greater detail.

Figure 5:
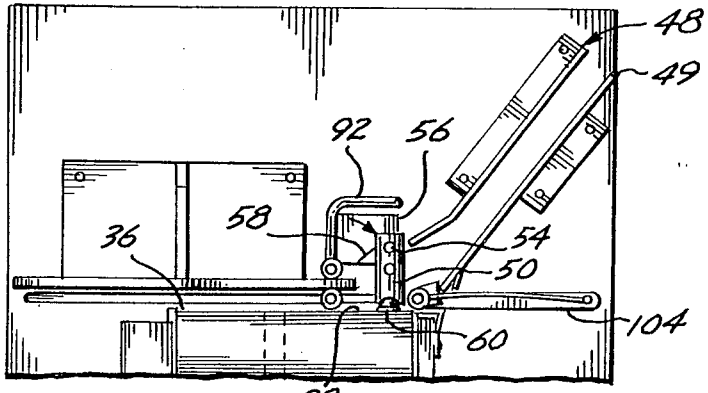
FIGS. 4 through 9 are top elevation views of the loaded envelope feeder as it sequences through an envelope separation and removal cycle; and, FIG. 10 is a breakaway top elevation view of the shuttle assembly.

Although the preferred embodiment illustrated in FIG. 2 includes four suction heads 50, a greater or lesser number may be used depending on the size of the envelopes to be fed. The suction heads 52 are mounted and spaced periodically on a gripper rod 54 projecting upwardly through a channel 56 formed in the base 22 in proximity to the gripping-surface portion 38 of the outermost envelope 36. The lower end of the gripper rod 54 is affixed to one end of a pivot arm 58, with the other end of the pivot arm 58 being pivotally secured to the lower surface 26 of the base 22 (refer to FIG. 5). The pivot arm 58 is pivoted by a conventional cam and motor assembly (not shown for clarity) in order to move the gripper rod 54 arcuately between a release position, as shown in FIG. 4, in which the suction heads 50 are spaced away from the gripping-surface portion 38 of the outermost envelope 36, and a pickup position, as shown in FIG. 5, in which the suction heads 50 are adjacent and perpendicular to the gripping-surface portion 38.

Figure 6:
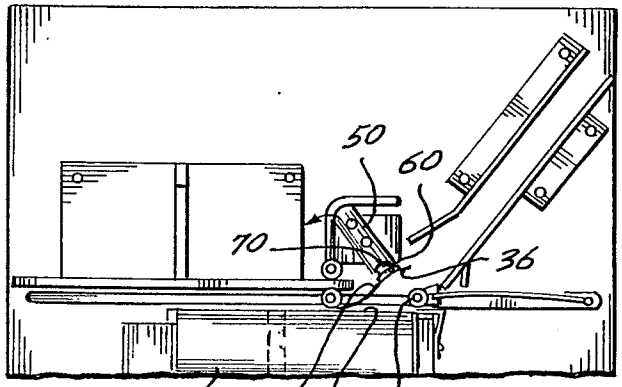

Referring again to FIG. 2, each suction head 50 includes a flexible suction cup gripper 60 affixed to one end, with the suction cup grippers 60 contacting the gripping-surface portion 38 when the gripper rod 54 is in its pickup position. Each suction head 50 is connected by tubing 62 to a vacuum system that includes a conventional solenoid valve and a vacuum pump. When the gripper rod 54 is moved to its pickup position (FIG. 5), a partial vacuum is drawn by the vacuum system through the tubing 62, the suction heads 50, and suction cup grippers 60, causing the gripping-surface portion 38 to be drawn against and gripped by the suction cup grippers 60. When the gripper rod 54 is returned to its release position with the partial vacuum still drawn, the gripping-surface portion 38 is lifted and peeled away from the underlying envelope 68 of the stack 18, as shown in FIG. 6. When the partial vacuum is released later in the envelope removal cycle, the suction cup grippers 60 detach from the gripping-surface portion 38.

As shown in FIG. 6, each suction head 50 includes an arcuate recess 70 formed across its end at the point of attachment to the suction cup grippers 60, with the central axis of the arcuate recesses 70 being parallel to the gripper rod 54. The arcuate recesses 70 act to distort the suction cup grippers 60 and the gripping-surface portion 38 into a generally saddle-shaped profile while a partial vacuum is drawn, ensuring that the underlying envelope 68 is not lifted together with the gripping-surface portion 38.

A conventional electromechanical pickup controller 72, housed within the order-finishing station 10 (FIG. 1) controls the movement of the gripper rod 54 and the operation of the vacuum system during the sequence of removing the outermost envelope 36 from the stack 18.

Figure 3:
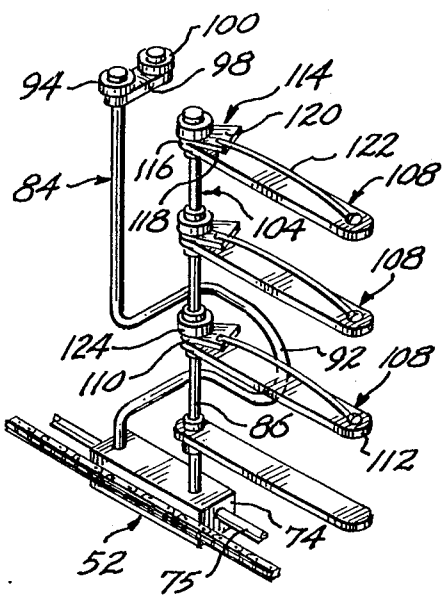
FIG. 3 is an isometric view of the shuttle assembly.

The envelope feeder 20 also includes a shuttle assembly 52 for separating and removing the outermost envelope 36. Referring to FIGS. 2 and 3 for detail, the shuttle assembly 52 includes a shuttle block 74 slidably secured to a slider rod 75 mounted beneath the lower surface 26 of the base 22. The shuttle block 74 slides back and forth below a shuttle slot 76 formed through the base 22, parallel and adjacent the retaining plate 28 on the same side as the stack 18 of envelopes. The shuttle block 74 is affixed to and moved by a conventional drive belt 78 passing over a cog 80 and a motor 82. A stand-off rod 84 and parallel separator rod 86 project upwardly through the shuttle slot 76 and are perpendicular to the base 22. When the shuttle block 74 is located under the midpoint of the shuttle slot 76, the stand-off rod 84 and separator rod 86 are located between the retaining plate 28 and the stack 18, with the separator rod 86 being closest to the gripping-surface portion 38 of the outermost envelope 36.

The retaining plate 28 is mounted on the bracket 29 so as to leave a gap between the retaining plate 28 and the base 22. The order-finishing station 10 includes a conventional bar code reader (not shown) that views a bar code printed on the outermost envelope 36 through the gap. The stand-off rod 84 includes a horseshoe-shaped bent portion 92 that projects through the gap so that stand-off rod 84 does not block the view of the bar code reader.

A stand-off roller 94, made of a low-friction material such as lubricant-impregnated DELRIN thermoplastic resin, is rotatably secured to the upper extremity of the stand-off rod 84 and contacts the inner surface 97 of the retaining plate 28. A narrow, elongated roller slot 96 is formed along the upper edge of the retaining plate 28. A roller extension 98 secured to the stand-off rod 84 just below the stand-off roller 94 projects outwardly through a roller slot 96, and a stabilizing roller 100 is rotatably secured to the roller extension 98 and contacts the outer surface 102 of the retaining plate 28. The sandwiching of the retaining plate 28 between the stand-off roller 94 and the stabilizing roller 100 prevents the stand-off rod 84 and the separator rod 86 from tilting out of perpendicularity with the base 22.

A separator assembly 104 for splitting the outermost envelope 36 from the underlying envelope 68 is affixed to the separator rod 86. The separator assembly 104 could be constructed in a variety of configurations, as long as it has a narrow separating edge for ease of insertion between envelopes 36 and 68, and has a small total surface area to prevent binding on any adhesive contained on envelopes 36 and 68. In the preferred embodiment illustrated in FIGS. 2 and 3, the separator assembly 104 is formed by four shuttle fingers 108 attached to and spaced periodically along the separator rod 86. Each shuttle finger 108 is formed from a thin, rigid sheet material, and has an oblong shape, with a semicircular separating tip 110 attached to the separator rod 86. In the preferred embodiment, the shuttle fingers 108 are formed from steel sheet. The shuttle fingers are parallel to the retaining plate 28, and project outwardly from the stack 18, terminating in a semicircular trailing end 112. The aligned separating tips 110 form the separating edge of the separator assembly 104.

Three latching tabs 114 are rotatably secured to the separator rod 86, as shown in FIG. 3, with one latching tab 114 located adjacent the upper surface of each of the three uppermost separating tips 110. Each latching tab 114 is formed from a thin, rigid sheet material, such as steel, and has a generally triangle-shaped perimeter. One edge of the perimeter is rounded off to form an arc-shaped end 116, having a radius generally matching the radius of the separating tips 110, and extends on either side to form a right-angle tip 118 and an acute angular latching tip 120. The latching tabs 114 are rotatably secured to the separator rod 86 by their arc-shaped ends 116, and rotate between a separating position, in which they overlie and are parallel to the shuttle fingers 108, and a removal position, as shown in FIG. 3, in which the latching tips 120 project outwardly toward the retaining plate 28.

The latching tabs 114 are biased toward their removal positions by curved wire springs 122, each wire spring 122 being attached at one end to the right-angle tip 118 of a latching tab 114 and at the other end to the trailing end 112 of a shuttle finger 108, and may be depressed to their separating positions. Referring to FIG. 2, the inner surface 97 of the retaining plate 28 includes three shallow grooves 121, located parallel to the roller slot 96, for receiving the latching tips 120 when the latching tabs 114 are in their removal positions.

The separator assembly 104 also includes three separator rollers 124, made of a low-friction material such as lubricant-impregnated DELRIN thermoplastic resin rotatably secured to the separator rod 86, with one separator roller 124 located above each latching tab 114.

The movement of the shuttle assembly 52, which includes the stand-off rod 84 and the separator assembly 104, is controlled by a conventional electro-mechanical separating controller 126 housed within the order-finishing station 10 (FIG. 1). The shuttle assembly 52 slides along the shuttle slot 76 between a retracted position, illustrated in FIG. 4, and an inserted position, illustrated in FIG. 8. In the retracted position (FIG. 4), the stand-off rod 84 is located between the stack 18 and the retaining plate 28 in proximity to the gripper rod 54 and the separator assembly 104 is located adjacent the stack 18, with the separator rollers 124 barely overlapping the gripping-surface portion 38 of the outermost envelope 36. In the inserted position (FIG. 8), the stand-off rod 84 is outside of the opposite side of the stack 18, and the separator assembly 104 is inserted between the stack 18 and the retaining plate 28, with the separating tips 110, latching tabs 114, and separator rollers 124 projecting outwardly from the stack 18, between the retaining plate 28 and the second side plate 42.

Figure 7:
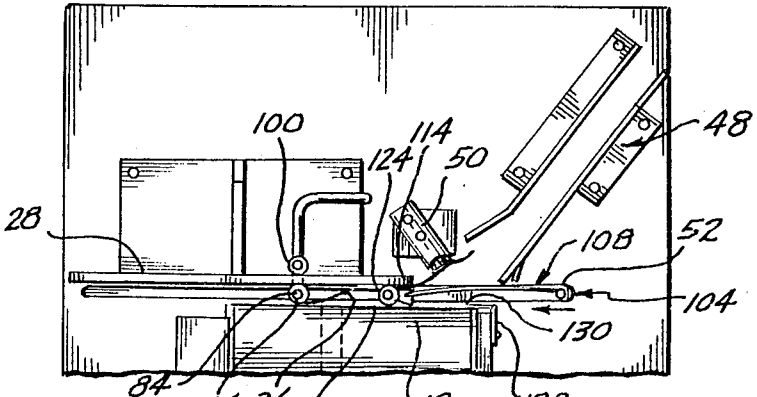

Movement of the shuttle assembly 52 effects the positioning of a spring holder 128, attached to the outer surface of the first side plate 40. The spring holder 128 is made of thin spring steel sheet, and includes an envelope-holding portion 130 bent around the first side plate 40 and projecting inwardly toward the stack 18. When the shuttle assembly 52 is moved from its retracted position, the spring holder 128 rests against the outer surface of the first side plate 40, and the envelope-holding portion 130 slightly overlaps the stack 18 of envelopes, as shown in FIG. 7. When the shuttle assembly 52 is in its retracted position, the spring holder 128 is bent away from the first side plate 40, as shown in FIG. 4.

OPERATION

Having described the mechanism of the envelope feeder 20, the operation of the envelope feeder will be described with reference to FIGS. 4 through 9, which illustrate a complete envelope separation and removal cycle. Beginning with FIG. 4, the cycle starts with the gripper rod 54 in its released position and the separator assembly 104 in its retracted position. The stack 18 of envelopes is spaced slightly away from the retaining plate 28 by the presence of the stand-off rod 84. The separator rollers 124 overlap the stack 18, preventing the gripping-surface portion 38 of the outermost envelope 36 and the underlying envelopes from projecting outwardly past the retaining plate 28.

Referring next to FIG. 5, the pickup controller 72 then causes the gripper rod 54 to move arcuately to its pickup position, in which the suction cup grippers 60 on the suction heads 50 contact the gripping-surface portion 38 of the outermost envelope 36. The pickup controller 72 then causes a partial vacuum to be drawn through the suction heads 50 and suction cup grippers 60 to grip outermost envelope 36.

As shown in FIG. 6, the pickup controller 72 then causes the gripper rod 54 to move back to its release position, with the partial vacuum still being drawn, causing the gripping-surface portion 38 of the outermost envelope 36 to be drawn from under the separator rollers 124 and to be lifted and peeled away from the underlying envelope 68. The arcuate recesses 70 on the ends of the suction heads 50 cause the suction cup grippers 60 and the outermost envelope 36 to bend in toward the suction heads 50, preventing the gripping and lifting of the underlying envelope 68.

Referring next to FIG. 7, the separating controller 126 then causes the shuttle assembly 52 to begin sliding toward its inserted position. The stand-off rod 84 moves between the retaining plate 28 and the outermost envelope 36, with the stand-off roller 94 and the stabilizing roller 100 traveling along either side of the retaining plate 28. As the separator assembly 104 begins to move across the stack 18 of underlying envelopes, the spring holder 128 is released so that its envelope-holding portion 130 slightly overlaps the underlying envelope 68, preventing that envelope and other envelopes in the stack 18 from projecting outwardly and interfering with the movement of the shuttle assembly 52.

Still referring to FIG. 7, the separating tips 110 of the shuttle fingers 108 are inserted between the outermost envelope 36 and the underlying envelope 68, splitting the outermost envelope 36 away from the stack 18 and pressing it against the retaining plate 28. The presence of the outermost envelope between the retaining plate 28 and the shuttle fingers 108 causes the latching tabs 114 to be depressed to their separation positions. The low-friction separator rollers 124 roll against the outermost envelope 36 if it separates freely from the underlying envelope 68 but slide between the outermost envelope 36 and the underlying envelope 68 at points of adhesion to aid in splitting the envelopes apart. The generally elongated S-shaped bend formed in the outermost envelope 36 between the stand-off roller 94 and the separator rollers 124 also enhances the splitting action of the shuttle fingers 108.

Figure 8:
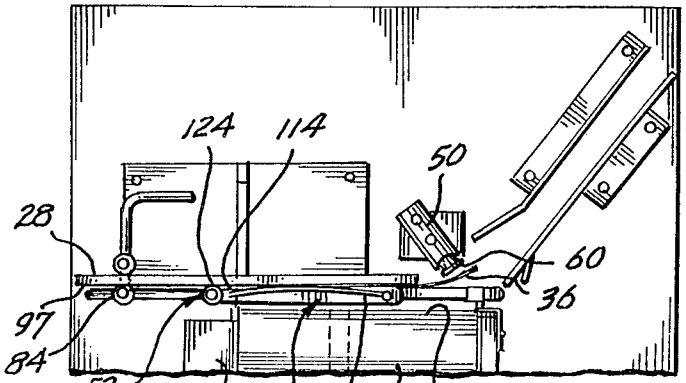

When the shuttle assembly 52 has moved completely to its inserted position, as shown in FIG. 8, the stand-off rod 84 has passed over and past the stack 18 of envelopes, and the separator assembly 104 is inserted completely between the outermost envelope 36 and the underlying envelope 68. The outermost envelope 36 is sandwiched between the shuttle fingers 108 and the retaining plate 28. At this point, the latching tabs 114, now clear of the outermost envelope 36, are moved to their removal positions by the wire springs 122 and project into the grooves 121 in the inner surface 97 of the retaining plate 28. Once the shuttle assembly 52 is fully inserted, the pickup controller 72 causes the partial vacuum drawn through the suction heads 50 to be released, resulting in detachment of the outermost envelope 36 from the suction cup grippers 60 in preparation for removal of that envelope from the stack 18.

Figure 9:
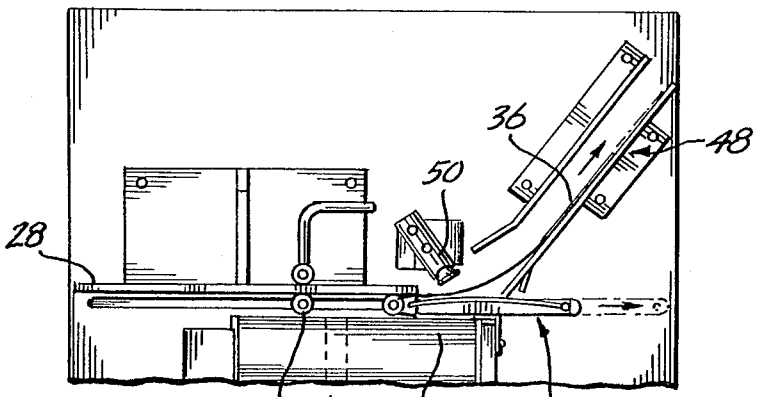
Figure 10:
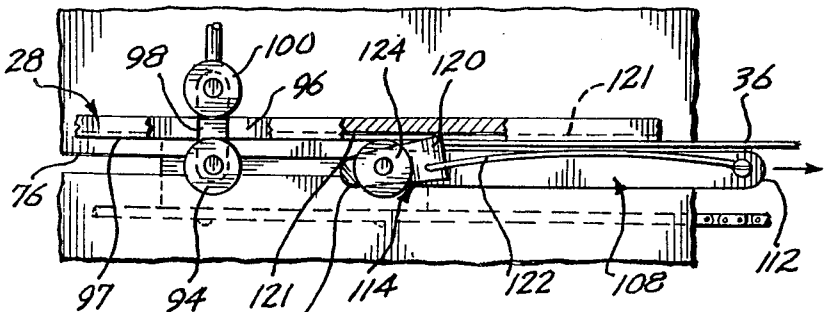

The final step of the cycle, removal of the outermost envelope 36, is illustrated in FIG. 9. The separating controller 126 causes the shuttle assembly 52 to return to its retracted position, carrying the outermost envelope 36 with it. As shown in the detailed view of FIG. 10, the latching tips 120 of the latching tabs 114, traveling within the grooves 121, engage with the outermost envelope 36, pushing that envelope off of the stack 18 as the shuttle fingers 108 withdraw from the stack 18.

As the shuttle assembly 52 moves to its retracted position (FIG. 9), the stand-off rod 84 is reinserted between the stack 18 and the retaining plate 28, and the outermost envelope 36 slides into the envelope receptacle 48 to await processing by the station operator.

When that envelope is removed from the envelope receptacle by the operator, a new envelope separation and removal cycle is initiated by the pickup controller 72 and separating controller 126 to remove the next envelope from the stack 18 of envelopes. The stack-holding tray 30 is advanced inwardly toward the retaining plate 28 by the spring motor 33 to maintain compression on the stack 18 as the stack 18 decreases. When all envelopes from the stack have been fed, the stack-holding tray 30 is pulled back by the operator and a new stack 18 of envelopes is loaded into the envelope feeder 20.

The present invention has been described in relation to a preferred embodiment. The present invention may also be used to feed other sheet materials in addition to photographic envelopes, such as sheets of paper or plastic, or pamphlets. The description of the invention in terms of a photographic envelope feeder exemplifies one possible usage of the invention, and should not be considered as a limitation on the environment in which the invention may be used.

One of ordinary skill, after reading the foregoing specification, will be able to effect various changes, alterations, and substitutions of equivalents without departing from the broad concepts disclosed.

For example, the outermost sheet may be lifted from the stack by an alternate pickup deivce, such as a mechanical hooking mechanism, rather than through the use of a vacuum. The removal of a sheet from the stack, once that sheet had been separated from the stack, could be accomplished by maintaining a grip on the sheet and moving the pickup device to slide the sheet from the stack prior to retracting the separator assembly from the stack. Similarly, the separator assembly could be embodied as a solid plate with a plurality of flanges formed on its surface to reduce surface contact with the envelopes, rather than utilizing separate shuttle fingers. The separator assembly could also be constructed from, or have an outer coating of, a low-friction material such as polytetrafluoroethylene.

As such changes can be made to the illustrated embodiment, it is intended that the scope of Letters Patent granted hereon be limited only by the definitions contained in the appended claims and the equivalents thereof.

The embodiments of the invention in which an exclusive property or privilege is claimed are defined as follows:

1. An apparatus for removing the outermost sheet from a stack of sheets comprising:

a base;

a stack-holding tray movably mounted on said base;

a retaining member secured to said base for retaining said stack of sheets, said outermost sheet facing said retaining member;

tray-advancing means associated with said stack-holding tray and operable to advance said stack-holding tray toward said retaining member to compress said stack of sheets;

a sheet pickup means, mounted on said base, for detachably gripping said outermost sheet and partially lifting said outermost sheet from said stack;

a shuttle having a separating end for separating said partially lifted outermost sheet from said stack, said shuttle being formed from a plurality of interconnected, parallel shuttle fingers, each said shuttle finger having a separating tip, said shuttle being movably secured to said base and movable between a retracted position, in which said shuttle is adjacent said stack, and an inserted position, in which said shuttle is inserted between said outermost sheet and said stack, said shuttle further including a plurality of rollers, rotatably secured to said separating tips;

removal means movably mounted on said base for engaging and removing said separated outermost sheet from said stack; and control means for cooperatively controlling said sheet pickup means and said separating means.

2. The apparatus of claim 1, wherein said sheet pickup means comprises:

a suction member having a flexible cup gripper end, said suction member including an arcuate recess adjacent said flexible cup to resiliently deform said flexible cup into a saddle shape when said gripper end grips said outermost sheet;

vacuum means in fluid communication with said suction member and selectively operable to draw a partial vacuum through said suction member; and positioning means associated with said suction member and operable to move said suction member between a pickup position, in which said suction member is adjacent said outermost sheet and said gripper end contacts said outermost sheet, and a release position, in which said suction member is spaced away from said outermost sheet, said vacuum means operating to draw a partial vacuum when said suction member is in its pickup position, resulting in said gripper end gripping said outermost sheet and partially lifting said outermost sheet from said stack when said suction member is moved to its release position.

3. In an order-finishing station at which photographic prints and developed film are brought together for placement into customer envelopes, an envelope feeder for removing an outermost envelope from a stack of envelopes and presentin that envelope to an operator, comprising:

a base mounted in said order-finishing station;

a stack-holding tray movably secured to said base;

a retaining member secured to said base for retaining said stack of envelopes, said outermost envelope facing said retaining member;

tray-advancing means associated with said stack-holding tray and operable to advance said stack-holding tray toward said retaining member to compress said stack of envelopes;

an envelope pickup means, securd to said base, for detachably gripping said outermost envelope in said stack and partially lifting said outermost envelope from said stack;

a shuttle having a separating end for separating said partially lifted outermost envelope from said stack, said shuttle being formed from a plurality of interconnected parallel shuttle fingers, each said finger having a separating tip, said shuttle being movably secured to said base and movable between a retracted position, in which said shuttle is adjacent said stack, and an inserted position, in which said shuttle is inserted between said outermost envelope and said stack, said separating end projecting outwardly between said outermost envelope and said stack when said shuttle is in its inserted position and said envelope pickup means detaching from said outermost envelope when said shuttle is in its inserted position;

removal means movably mounted on said base for engaging and removing said separated outermost envelope from said stack, said removal means including a latching tab rotatably secured to said separating end and rotatable between a separating position, in which said latching tab overlies said shuttle fingers, and a removal position, in which said latching tab projects outwardly toward said retaining member, and latching tab biasing means for biasing said latching tab to its removal position such that, as said shuttle moves from its retracted position to its inserted position, said latching tab is depressed to its separating position and, as said shuttle moves from its inserted position to its retracted position, said biasing means causes said latching tab to rotate to its removal position, thereby engaging said outermost envelope to remove said outermost envelope from said stack; and control means for cooperatively controlling said envelope pickup means and said separating means.

4. The envelope feeder of claim 3, further comprising an envelope receptacle for receiving the outermost envelope after removal from the stack.

5. An apparatus for removing the outermost sheet from a stack of sheets, comprising:

a base;

a stack-holding tray movably mounted on said base;

retaining member secured to said base for retaining said stack of sheets, said outermost sheet facing said retaining member;

tray-advancing means associated with said stack-holding tray and operable to advance said stack-holding tray towards said retaining member to compress said stack of sheets;

a sheet pickup means, mounted on said base, for detachably gripping said outermost sheet and partially lifting said outermost sheet from said outermost stack;

a shuttle having a separating end for separating said partially lifted outermost sheet from said stack, said shuttle being formed from a plurality of interconnected, parallel shuttle fingers, each said shuttle finger having a separating tip, said shuttle being movably secured to said base and movable between a retracted position, in which said shuttle is adjacent said stack, and an inserted position in which said shuttle is inserted between said outermost sheet and said stack;

stand-off means, secured to said shuttle and generally disposed between said outermost sheet and said retaining member, for creating a gap between said stack and said retaining member to aid the movement of said shuttle between its retracted and inserted positions;

removal means movably mounted on said base for engaging and removing said separated outermost sheet from said stack; and control means for cooperatively controlling said sheet pickup means and said separating means.

6. The apparatus of claim 5, wherein said separating end passes completely between said outermost sheet and said stack to a point beyond said stack when said shuttle is moved to its inserted position; said sheet pickup means detaches from said outermost sheet when said shuttle is in its inserted position; and, said removal means comprises:

a latching tab rotatably secured to said separating end and rotatable between a separating position, in which said latching tab overlies said shuttle fingers, and a removal position, in which said latching tab projects outwardly toward said retaining member; and latching tab biasing means for biasing said latching tab to its removal position, such that as said shuttle moves from its retracted position to its inserted position, said latching tab is depressed to its removal position, and as said shuttle moves from its inserted position to its retracted position, said biasing means causes said latching tab to rotate to its separating position, engaging said outermost sheet to remove said outermost sheet from said stack.

* * * * *

UNITED STATES PATENT AND TRADEMARK OFFICE

CERTIFICATE OF CORRECTION

PATENT NO. : 4,974,825

DATED : December 4, 1990

INVENTOR(S) : Milan Bizic et al.

It is certified that error appears in the above-identified patent and that said Letters Patent is hereby corrected as shown below:

| Column | Line | Error |
|---|---|---|
| Abstract | 8 | delete "the" and insert therefor --then-- |
| 1 | 41 | delete "seperation" and insert therefor --separation-- |
| 3 | 51 | delete "dirupted" and insert therefor --disrupted-- |
| 6 | 63 | delete "electro-mechanical" and insert therefor --electromechanical-- |
| 10 | 24 | delete "presentin" and insert therefor --presenting-- |
| 10 | 35 | delete "securd" and insert therefor --secured-- |
| 11 | 13 | insert the word --a-- before "retaining" (first occurrence) |
| 11 | 18 | delete "towards" and insert therefor --toward-- |
| 12 | 28, 29 | delete "removal" and insert therefor --separating-- |
| 12 | 32 | delete "separating" and insert therefor --removal-- |

Signed and Sealed this

Twenty-second Day of December, 1992

*Attest:*

DOUGLAS B. COMER

*Attesting Officer*

*Acting Commissioner of Patents and Trademarks*